United States Patent [19]

Voetter et al.

[11] 4,419,215

[45] Dec. 6, 1983

[54] METHOD OF PRE-HEATING PARTICLES OF A HYDROCARBON-BEARING SUBSTRATE AND AN APPARATUS THEREFOR

[75] Inventors: Heinz Voetter; Hubrecht C. A. Van Meurs; Richard C. Darton, all of The Hague; Rajamani Krishna, Amsterdam, all of Netherlands

[73] Assignee: Shell Internationale Research Maatschappij B.V., The Hague, Netherlands

[21] Appl. No.: 369,684

[22] Filed: Apr. 19, 1982

[30] Foreign Application Priority Data

Apr. 22, 1981 [GB] United Kingdom ..... 8112490

[51] Int. Cl.[3] ..... C10G 1/00; F28D 13/00

[52] U.S. Cl. ..... 208/11 R; 208/8 R; 201/12; 201/14; 201/31; 165/164.16; 165/DIG. 27

[58] Field of Search ..... 208/8 R, 11 R; 201/12, 201/31, 14; 165/104.16, DIG. 27

[56] References Cited

U.S. PATENT DOCUMENTS

| | | | |
|---|---|---|---|
| 2,285,276 | 6/1942 | Hemminger | 208/11 R X |
| 2,581,041 | 1/1952 | Ogorzaly et al. | 201/14 |
| 2,697,688 | 12/1954 | Nicolai | 208/11 R X |
| 3,703,442 | 11/1972 | Rammler et al. . | |
| 3,929,615 | 12/1975 | Linden et al. | 208/11 R |
| 4,110,192 | 8/1978 | Gwyn et al. . | |
| 4,260,371 | 4/1981 | O'Feill | 165/104.34 |
| 4,292,742 | 10/1981 | Ekberg | 432/58 |

FOREIGN PATENT DOCUMENTS 1023492 6/1963 United Kingdom .

OTHER PUBLICATIONS

"Energy Recovery From Hot Particulate Solids" by O. E. Poiter, AUS. I.M.M. Coference, Sydney, NSW, Jul. 1981,. pp. 269–279.

Olsen, "Chapter 1–Heat and Power", *Unit Processes and Principles of Chemical Engineering,* Van Nostrand Co., Inc., 1932, pp. 1–3.

*Primary Examiner*—Delbert E. Gantz
*Assistant Examiner*—Lance Johnson
*Attorney, Agent, or Firm*—Jones, Tullar & Cooper

[57] ABSTRACT

Hydrocarbon-bearing substrate particles are pre-heated by heating the same with a solid heat-bearing medium by indirect counter-current flow using a series of heat transfer loops each containing a circulating heat transfer medium chosen such that the whole series permits a staged rise in temperature of the substrate particles and a staged drop in temperature of the solid heat-bearing medium. Preferably the heat transfer fluid in the loops circulates between the substrate and the hot spent substrate by means of the so-called thermosyphon effect.

An apparatus for carrying out the method is described.

14 Claims, 4 Drawing Figures

METHOD OF PRE-HEATING PARTICLES OF A HYDROCARBON-BEARING SUBSTRATE AND AN APPARATUS THEREFOR

BACKGROUND OF THE INVENTION

This invention relates to a method of pre-heating particles of a hydrocarbon-bearing substrate, for example an oil shale, tar sand or a bituminous coal.

It is well known that hydrocarbons can be extracted from such hydrocarbon-bearing substrates by heating particles of the substrate at a temperature of at least 400° C. in the substantial absence of oxygen, and recovering the liberated hydrocarbons. In the case of oil shale this process is usually referred to as retorting and, in the case of bituminous coal, is called pyrolysis.

In a number of different known processes the heating of the substrate particles is carried out by heat exchange with a heat-bearing medium. Such a heat-bearing medium may, for example, be a solid medium consisting of inert particles which are heated in a separate vessel and then circulated through the extraction vessel.

Certain of the known retorting processes make use of the fact that the spent substrate, i.e. the substrate after extraction of the hydrocarbons, may contain appreciable amounts of coke. It has therefore been proposed to generate the heat required for the retorting process by complete or partial combustion of this coke to produce a hot spent substrate. This hot spent substrate may be employed as heat-bearing medium for the extraction process.

It is desirable that the substrate particles used in such an extraction process have been subjected to a separate pre-heating step. This pre-heating step essentially involves heating the substrate particles to a temperature below that at which the main extraction process takes place. Heat transfer to the substrate particles in the pre-heating step may be carried out by any suitable method, but it would be more advantageous if the heat required is taken from the hot spent substrate itself.

OBJECTS AND SUMMARY OF THE INVENTION

It is an object of the present invention to provide a method of pre-heating hydrocarbon-bearing substrate particles prior to the latter being subjected to an extraction process as described.

It is a particular object to provide such a method in which the pre-heating is carried out by means of indirect heat exchange with a solid heat-bearing medium and for this purpose hot spent substrate is used as the heat-bearing medium.

Accordingly, the present invention provides a method of pre-heating hydrocarbon-bearing substrate particles, which comprises heating the substrate particles with a solid heat-bearing medium by indirect counter-current flow using a series of heat transfer loops each containing a circulating heat transfer medium chosen such that the whole series permits a staged rise in temperature of the substrate particles and a staged drop in temperature of the solid heat-bearing medium.

Any solid heat-bearing medium such as sand may be applied in the method of pre-heating in accordance with the invention. More preferably, however, the hot spent substrate as obtained in further processing of the hydrocarbon-bearing substrate for recovering its hydrocarbonaceous material is used as the solid heat-bearing medium.

The invention will be further described hereinafter whilst using such hot spent substrate as the heat-bearing medium.

The substrate particles and the hot spent substrate are preferably each maintained in a substantially fluidized bed condition. Since in the case of certain substrates such as shale, substantial quantities of water may be liberated in the pre-heating, it is advantageous to use steam as the fluidizing gas at least when the temperature of the substrate is 100° C. or above. In this case it is desirable to recycle at least a part of the steam to the fluidized beds and, if necessary, to condense and recover the remainder. For the substrate at temperatures below 100° C. and also for the hot spent substrate, air may be conveniently used as the fluidizing gas.

The preferred method of circulation of the heat transfer fluid in the loops between the substrate and the hot spent substrate is by means of the so-called thermosyphon effect. By this method the fluid is vaporized by indirect contact with the hot spent substrate using suitable heat exchange elements. The generated vapour is then passed to heat exchange elements in the fluidized bed of substrate particles. Here the vapour is condensed and the liquid is returned to the heat exchange elements in the hot spent substrate. By suitable arrangement of the relative positions of the heat exchange elements in the substrate and hot spent substrate respectively, the use of pumps to circulate the fluid may be avoided.

The particular heat transfer fluids used in any one of the loops will depend on the particular operating temperature or temperature range of the loop. A suitable fluid for temperatures from about 65° to 100° C. is methanol and for temperatures from 100° to 300° C. pressurized water may be employed. For temperatures above 300° C., known mixtures of diphenyl and diphenyl oxide may, for example, be used.

The hot spent substrate to be used as the solid heat-bearing medium preferably has an initial temperature of 700° C. It may be obtained by further heating the pre-heated hydrocarbon-bearing substrate in the substantial absence of oxygen to yield a coke-bearing substrate and liberated hydrocarbons, the coke-bearing spent substrate being combusted with a free oxygen-containing gas in a separate combustion step to hot spent substrate.

In one embodiment of the pre-heating method the temperature of the substrate particles is raised in a staged manner from ambient temperature to about 250° C. and the temperature of the hot spent substrate is lowered from 700° C. to about 80° C. To achieve this a series of 7 heat transfer loops may be used, for which the operating temperatures of the heat transfer fluid are 65°, 82°, 112°, 150°, 216°, 300° and 300° C. respectively.

The preheating method of the present invention may be used as a first step in any extraction process for extracting hydrocarbons from a hydrocarbon-bearing substrate. Many such processes are based simply on the heating of the substrate in a vessel, which amounts essentially to one perfectly mixed stage. However, the solids residence time distribution in such a vessel is far from optimal and it is better if the solids pass through the vessel in a staged manner.

In one example of such a staged retorting process for oil shale hydrocarbon-bearing substrate and hot spent substrate are introduced into the upper portion of an elongated vertical vessel and are passed downwards through the vessel under substantially plug-flow conditions, while an inert stripping gas is passed upwardly through the solids in countercurrent flow, in order to remove the liberated hydrocarbons.

A disadvantage associated with the use of such a countercurrent retorting process arises from the fact that there is often appreciable contact in the retorting vessel between the liberated hydrocarbons and the hot substrate. This contact can give rise to cracking of the hydrocarbons and hence to loss of product due to coke formation.

A more preferred extraction process is a continuous process as described hereinafter, in which such contact is low and hydrocarbon product losses due to cracking are minimized.

In this preferred process hydrocarbons are extracted from a hydrocarbon-bearing substrate by heating particles of the substrate in the substantial absence of oxygen at a temperature of at least 400° C. to give a coke-bearing spent substrate and liberated hydrocarbons, which are recovered and in which process the substrate particles are heated by passage through a plurality of zones, in at least some of which zones the substrate particles are mixed with a solid heat-bearing medium, the mixture being maintained in a substantially fluidized bed condition, and the liberated hydrocarbons being removed by passage of inert stripping gas in cross-current flow with respect to the passage of the substrate particles.

The zones may, for example, be a series of separate but interconnected reaction vessels. Alternatively, the zones may be compartments formed by placing baffles in a single suitably shaped vessel. Such compartments are interconnected, for example, by means of openings in the baffles, to permit passage of the substrate particles. Alternatively, the substrate particles may pass from zone to zone over weirs located in the vessel. Preferably the zones are generally horizontally disposed. The number of zones is preferably such as to provide from 2 to 10 theoretical stages for the passage of the mixture.

The solid heat-bearing medium is preferably hot spent substrate obtained by the separate combustion of the carbon-bearing spent substrate as described above. This separate combustion may be carried out in any suitable manner. In a preferred embodiment, the combustion is carried out while maintaining the carbon-bearing substrate in a substantially fluidized condition. The said spent substrate may be partially or completely combusted in a riser/burner through which the spent substrate is lifted by flow of air, and then, if necessary, passed for further combustion to a fluidized bed combustor. The final temperature of the hot spent shale may be controlled by removing some of the heat produced by the combustion, for example, by generating steam using heat transfer elements placed within the bed. If insufficient heat is supplied by the combustion of the coke-bearing spent substrate, then this may be supplemented by the combustion of other carbon-bearing material, for example coal or fresh substrate.

It is a feature of the preferred extraction process that some or all of the zones are each separately supplied with heat-bearing medium. By adjustment of the amounts of heat-bearing medium supplied it is possible to regulate the temperature independently within each zone and thereby to control the course of the extraction reaction. For the retorting of oil shale the temperature in each zone is preferably maintained at 400° to 600° C., in particular 450° to 550° C. In one embodiment of a retorting process according to the invention using five zones, the temperature of the substrate particles is maintained at 450° C. in the first zone and at 480° C. in subsequent zones by addition of hot spent substrate, for example, at 700° C. For the pyrolysis of bituminous coal the temperature in the zones is preferably from 500° to 750° C.

The residence times of the substrate particles in each zone may be the same or different and for the temperature given above the residence time per zone is preferably of the order of 1 to 10 minutes.

As already mentioned above, the inert stripping gas is preferably steam although any other oxygen-free gas could also be used, for example product gas produced in the process may be compressed and recycled to the zones. The mixture of substrate particles and solid heat-bearing medium is maintained in the substantially fluidized bed condition by the cross-current passage of the inert stripping gas and by hydrocarbon vapours produced in the zone. An advantage associated with the maintenance of the substrate particles in a substantially fluidized bed condition is that mechanical means for moving the substrate particles from one zone to the next are not required. By the use of a plurality of zones relatively shallow fluidized beds may be maintained from which the hydrocarbons liberated in the retorting process are removed rapidly from the zone and the risk that the hydrocarbons undergo subsequent cracking is thereby reduced. A further advantage of the process of the invention is due to the rapid mixing of substrate and heat-bearing medium in the fluidized bed which attains a relatively uniform temperature and hence the formation of local "hot spots" leading to cracking and loss of yield is avoided.

The hydrocarbons liberated may be recovered by known techniques. For example they can be stripped of any entrained substrate particles in one or more cyclones and passed to conventional condensation/separation/treatment units.

The preferred extraction process is of particular interest for the extraction of hydrocarbons from oil shale containing preferably at least 5% of organic material. The diameter of the substrate particles fed to the process is suitably from 0.5 to 5 mm.

A further aspect of the invention is the provision of an apparatus suitable for carrying out the pre-heating method of the invention, comprising:

(a) a first vessel provided with a series of interconnected compartments, an inlet for fresh substrate particles associated with the first compartment of the series and an outlet for pre-heated substrate particles associated with the final compartment of the series, each compartment having a bottom inlet for a fluidizing gas and a top outlet for spent fluidizing gas;

(b) a second vessel provided with a series of interconnected compartments, an inlet for hot spent substrate associated with the final compartment of the series relative to the interconnected compartments of the first vessel and an outlet for cooled spent substrate associated with the first compartment of the series relative to the interconnected compartments of the first vessel, the said first vessel being positioned at a higher elevation than the said second vessel, and each compartment of the second vessel having a bottom inlet for a fluidizing gas and a top outlet for spent fluidizing gas, and (c) a plurality of heat transfer loops between the first vessel and the second vessel, each heat transfer loop connecting at least one compartment of the second vessel with a compartment of the first vessel.

Preferably, one or more of the heat transfer loops connect(s) a compartment of the second vessel with its corresponding compartment of the series of interconnected compartments of the first vessel. In this arrangement a heat transfer loop connects the first compartment of the first vessel with the first compartment of the second vessel, the second one of the first vessel with the second one of the second vessel and so on, the final compartment of the first vessel being connected with the final compartment of the second vessel. In case the total number of compartments of the second vessel is larger than the total number of compartments of the first vessel heat transfer loops may connect two or more compartments of the second vessel with the same compartment of the first vessel. A preferred heat transfer loop is a loop based on the thermosyphon system.

In the apparatus for preheating the particles one or more of the top outlets of the compartments of the second vessel may be connected, optionally via a cyclone for removal of entrained substrate particles, with a bottom inlet of a compartment of the first vessel, thereby using the spent fluidizing gas of the second vessel as a fluidizing gas in the first vessel.

BRIEF DESCRIPTION OF THE DRAWINGS

The invention is now illustrated further by reference to the accompanying drawings, in which.

A. a pre-heating zone;

B. a retorting zone;

C. a combustion zone.

Figure 2:
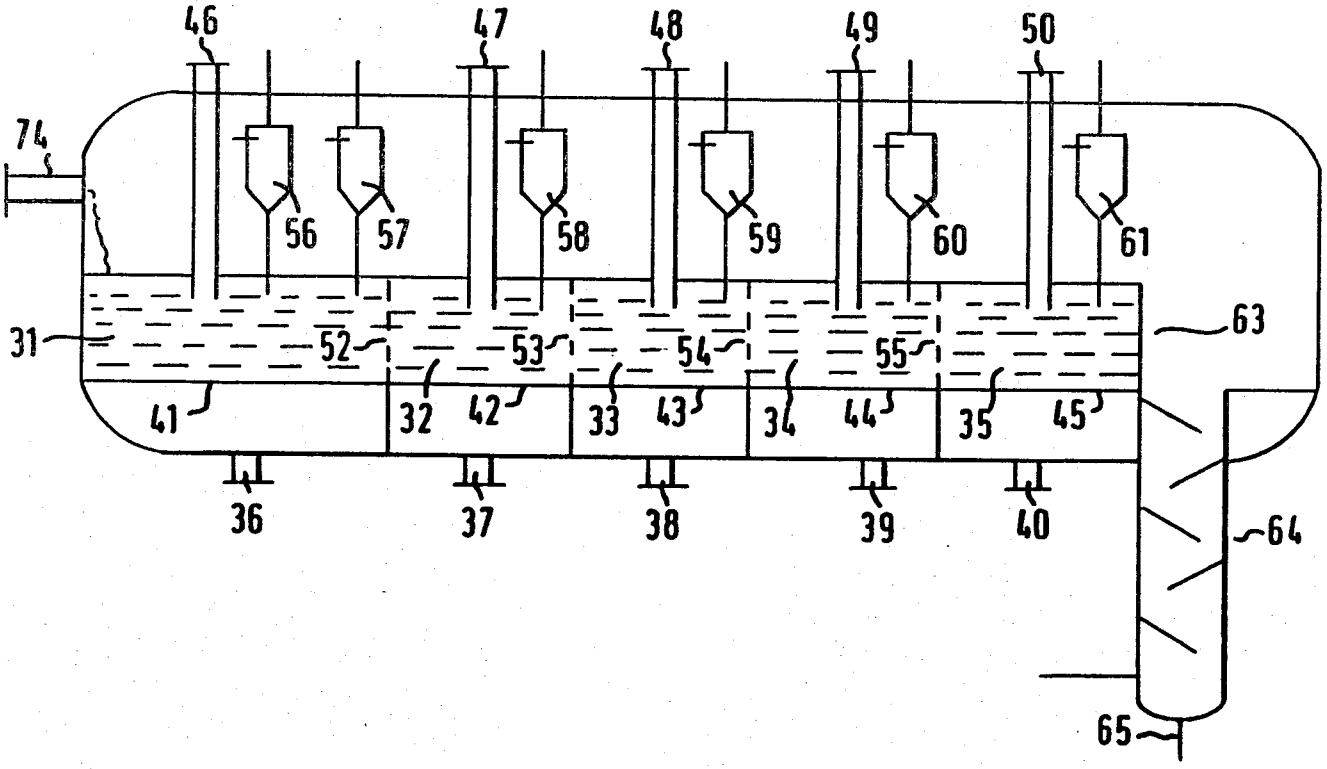

FIG. 2 is a more detailed representation of a retorting vessel for the extraction process.

Figure 3:
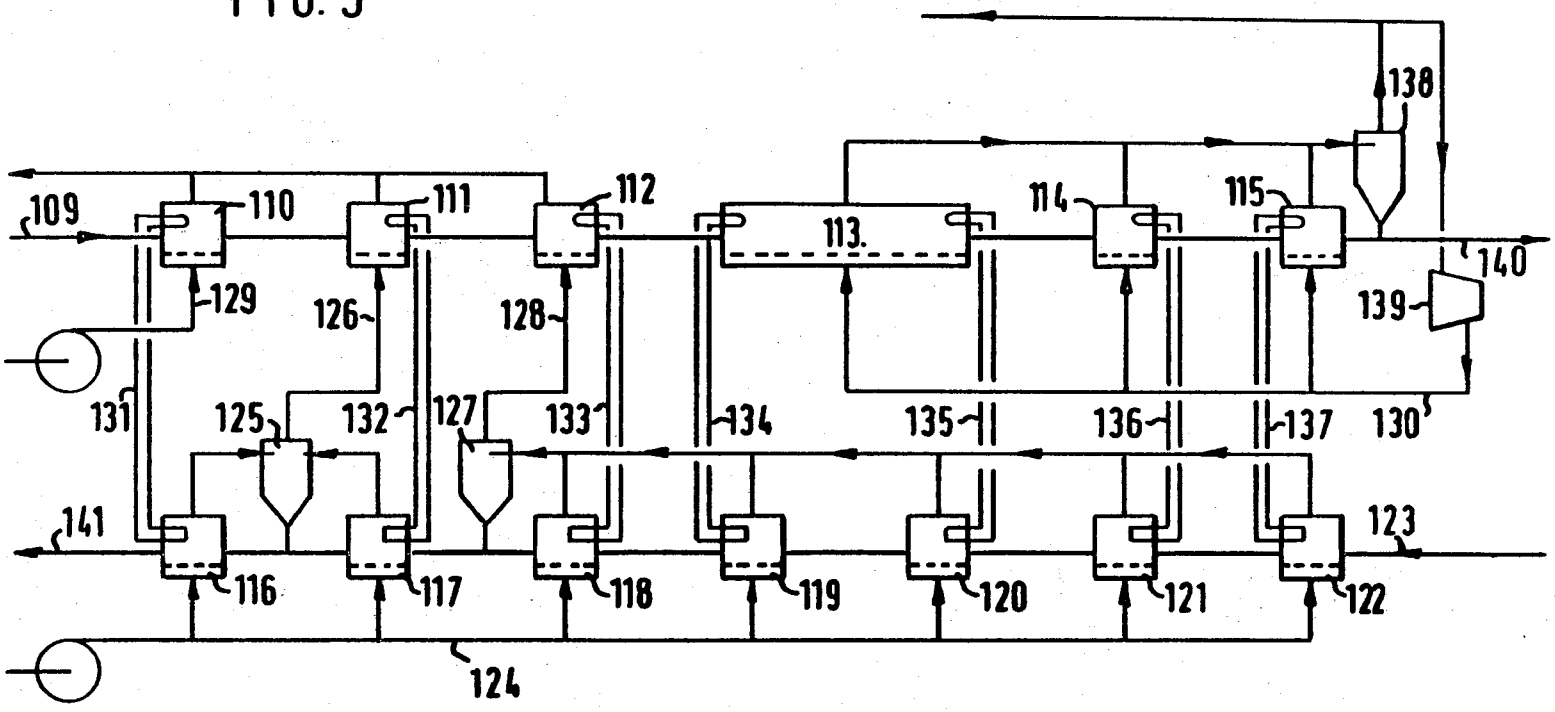
Figure 4:
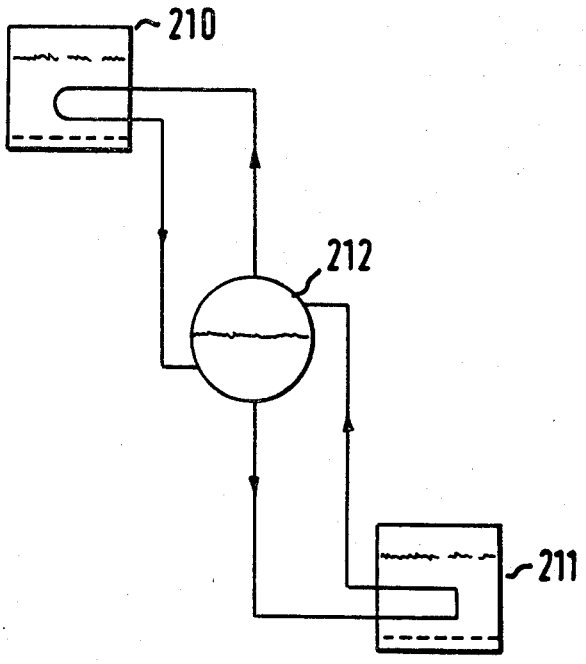

FIG. 3 is a more detailed representation of an alternative pre-heating zone A according to the invention, and FIG. 4 is a schematic representation of a heat transfer loop for the pre-heating zone.

DETAILED DESCRIPTION

Figure 1:
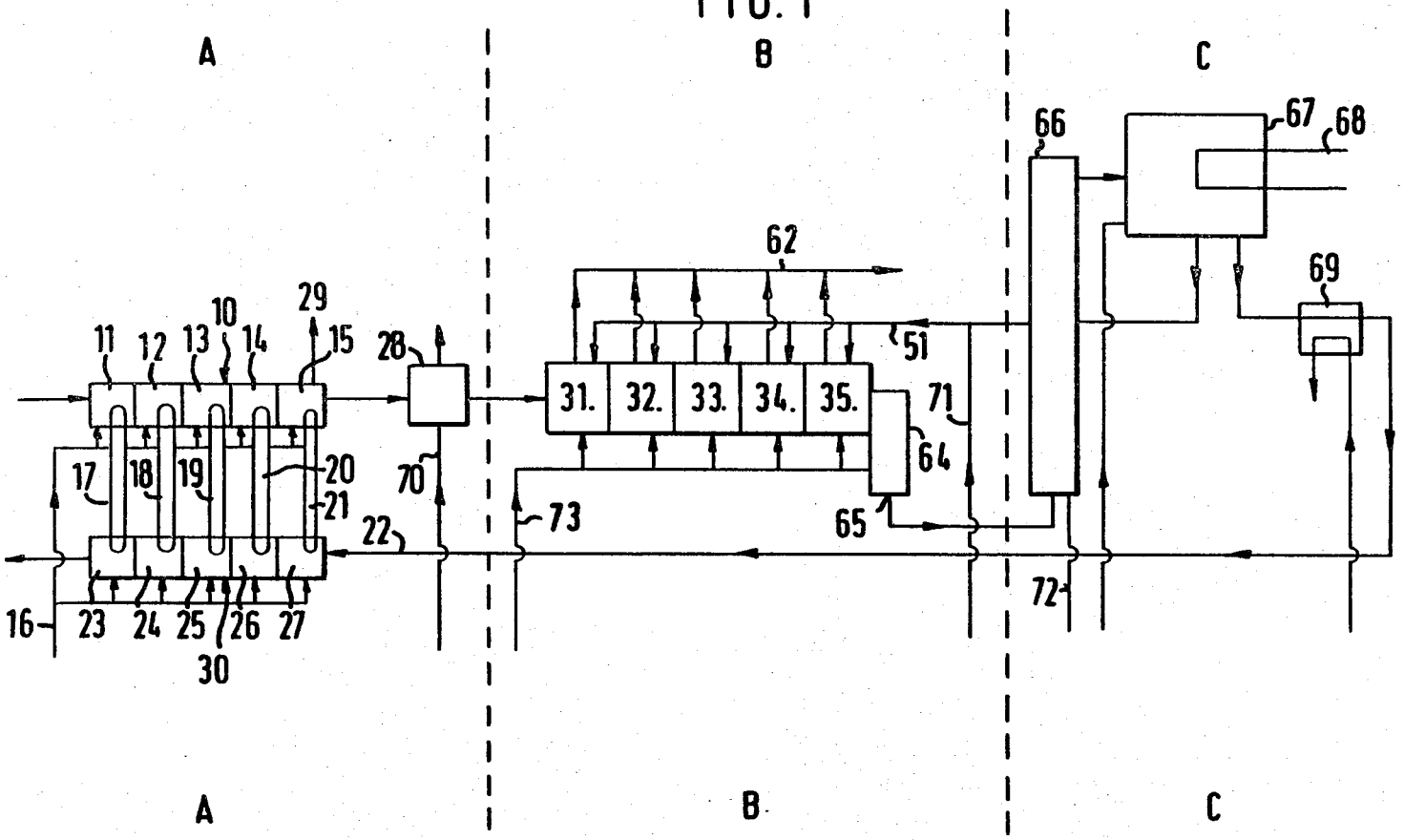
FIG. 1 is a flow scheme for a process for the extraction of hydrocarbons from oil shale applying the method of pre-heating according to the invention as a first step, said flow scheme comprising three parts.

Referring first to FIG. 1, the pre-heating zone A comprises a fresh shale pre-heating train 10 and a hot spent shale cooling train 30. Shale particles are fed at ambient temperature to the fresh shale train 10 which comprises five separate but interconnected compartments 11, 12, 13, 14 and 15. In each compartment shale particles are maintained in a fluidized bed state by passage of air via the supply line 16. Each compartment 11, 12, 13, 14 and 15 is heated separately by heat transfer from a heat exchange medium flowing through a heat exchange loop 17, 18, 19, 20 and 21 respectively. The heat exchange medium in each loop is heated by contact with hot spent shale which passes from the combustion zone C via the supply line 22 to the hot spent shale train 30. The hot spent shale train also comprises a series of five compartments 23, 24, 25, 26, 27, in each of which the spent shale is maintained in a fluidized bed condition by passage of air from the line 16. The direction of flow of the hot spent shale through the train 30 is a countercurrent to the direction of flow of the fresh shale through the train 10, hence the fresh shale is indirectly contacted in a staged manner with shale of progressively increasing temperature. Water vapour and any other volatile materials liberated during the pre-heating are withdrawn via the line 29.

After the passage through the train 10 the pre-heated shale is passed to the stripper 28 in which any air present in the shale is flushed out with steam supplied via the line 70. From the stripper 28 the shale is passed to the retorting zone B. The retorting vessel, which is shown in more detail in FIG. 2, has five compartments 31, 32, 33, 34, 35, each of which has a lower inlet 36, 37, 38, 39, 40 through which steam is passed via the line 73. Pre-heated shale enters the compartment 31 via the inlet 74 and passes successively to other compartments via the system of baffles 52, 53, 54, 55. In each of the compartments is a distributor 41, 42, 43, 44, 45 respectively, for ensuring a uniformly distributed supply of steam to the fluidized shale particles. Each compartment has separate upper inlets 46, 47, 48, 49, 50 for passing hot spent shale supplied via the line 51 from the combustion zone C into the fluidized bed of shale particles. Hydrocarbons liberated from the shale particles, together with steam from each zone, are passed via cyclones 56, 57, 58, 59, 60, 61 to a product removal line 62. From the compartment 35 the shale particles pass over a weir 63, through a steam stripper 64 to remove final traces of product and thence to the outlet 65.

The coke-bearing spent shale is then combusted in the combustion zone C. The shale particles from the stripper 64 are passed upwards with a stream of air which enters via the line 72 through a riser/burner 66 where the coke is partially combusted and from there to a fluidized bed combustor 67 in which the combustion is completed. Heat is removed from the fluidized bed combustor 67 by means of a water-cooling system for the generation of steam. The hot spent shale is withdrawn in two streams from the combustor 67. One stream is stripped with steam via the supply line 71 and passed via the line 51 to the retorting zone B. The other stream is passed via a second cooling system 69 and the line 22 to the spent shale train 30 of the pre-heating zone A. Hot flue gases are used in a conventional manner for generating steam via a convection bank and for preheating the air for the combustion.

Referring now to the pre-heating scheme of FIG. 3, the fresh shale train consists of six separate compartments in series 110–115 and the hot spent shale train consists of seven separate compartments in series 116–122. Fresh shale is supplied to the six compartments in series by means of line 109. The hot spent shale is passed via the line 123 successively to the compartments 122–116 and maintained in a fluidized bed condition in each compartment by means of air supplied via the line 124. Air from the compartments 116 and 117 is passed to the cyclone 125 and thence via the line 126 as fluidized gas to the shale in compartment 111 of the fresh shale train. Similarly, air from the compartments 118, 119, 120, 121 and 122 is passed through the cyclone 127 and via the line 128 is fluidizing gas to the shale in compartment 112 of the fresh shale train. The shale in compartment 110 is maintained in a fluidized bed condition by means of fresh air supplied via the line 129, and the shale in compartments 113, 114, 115 is fluidized by means of steam supplied via the line 130. The steam from the compartments 113, 114 and 115 together with water liberated from the shale is passed to the cyclone 138, and one stream is recompressed in the compressor 139 and returned to the line 130. The other stream is passed to a condenser (not shown). The water thus produced may be used for cooling purposes.

Heat transfer from the hot spent substrate to the fresh substrate is effected by means of the heat transfer loops 131–137. The compartments 110 and 116 are linked by the loop 131, the compartments 111 and 117 by the loop 132, the compartments 112 and 118 by the loop 133, the compartments 114 and 121 by the loop 136 and the compartments 115 and 122 by the loop 137. The compartment 113 of the fresh shale train is linked to two compartments 119 and 120 of the hot spent shale train by the loops 134 and 135 respectively.

FIG. 4 shows one possible mode of operation of a heat transfer loop by means of the thermosyphon effect. The compartment 210 of the fresh shale train is located at a higher elevation than the compartment 211 of the spent shale train. Heat transfer fluid in the liquid state passes from the vessel 212 to compartment 211 where it is evaporated by heat transfer from the hot spent shale. The vapour rises via the upper portion of the vessel 212 to the compartment 210 where it is recondensed by heat transfer to the fresh shale.

EXAMPLE 1

It is calculated that the process as described by reference to FIG. 1 may be operated continuously under the following conditions:

Shale Particles

Initial composition:
- water: 8.0%w
- organic material: 20.0%w
- minerals: 72.0%w Maximum diameter: about 2 mm A. Pre-heating Part
- Fresh shale feed: 58 kg/s
- Initial temperature shale particles: 25° C.
- Final temperature shale particles: 250° C.

B. Retorting Part
- Temperature hot spent shale: 700° C.
- Preheated shale feed rate: 53 kg/s

| Compartment | Temperature, °C. | Hot spent shale, kg/s |
|---|---|---|
| Number 1 | 450 | 50 |
| Number 2 | 480 | 22 |
| Number 3 | 480 | 2.5 |
| Number 4 | 480 | 1.1 |
| Number 5 | 480 | 0.5 |

Total recovered hydrocarbons: 7 kg/s.

C. Combustion Part
- Feed to riser burner; 122.1 kg/s
- Heat removed from fluidized bed combustor to maintain temperature of 700° C.; 36 MW.

EXAMPLE 2

The pre-heating method described by reference to FIG. 3 can be operated continuously under the detailed conditions shown below. The fresh oil shale supplied via line 109 is the same one as used in Example 1, both with respect to composition and particle diameter. The preheated oil shale particles leave the preheating zone via line 140 at a temperature of about 250° C. Hot spent shale at a temperature of about 700° C. is introduced via line 123 and passes countercurrently to the fresh oil shale through the preheating zone. It leaves the said preheating zone at a reduced temperature of about 80° C.

Hot spent shale is obtained from a fluidized bed combustor in which coke-bearing spent shale is combusted with air as described for zone C of FIG. 1.

| Fresh shale train: | shale feed | 58 kg/s |
|---|---|---|
| | initial temperature | 25° C. |
| Compartment | | Temperature, °C. |
| Number 110 | | 40 |
| Number 111 | | 55 |
| Number 112 | | 85 |
| Number 113 | | 105 |
| Number 114 | | 150 |
| Number 115 | | 250 |
| Hot spent shale train: | shale feed | 42 kg/s |
| | initial temperature | 700° C. |
| Number 122 | | 566 |
| Number 121 | | 461 |
| Number 120 | | 327 |
| Number 119 | | 197 |
| Number 118 | | 138 |
| Number 117 | | 109 |
| Number 116 | | 80 |

Heat transfer loops

| Loop | Fluid | Operating temperature, °C. | Operating pressure, bar |
|---|---|---|---|
| Number 131 | methanol | 65 | 1.0 |
| Number 132 | methanol | 82 | 1.8 |
| Number 133 | water | 112 | 1.5 |
| Number 134 | water | 150 | 5.0 |
| Number 135 | water | 216 | 22 |
| Number 136 | water | 300 | 90 |
| Number 137 | water | 300 | 90 |

The number of stages in the fresh shale train and in the hot spent shale train and the various temperature levels has been chosen such that the heat exchange per stage is an economic optimum. The considerations for choosing the particular heat exchange medium in the heat transfer loops for each stage are that in the first place its heat transfer coefficient should not limit the overall rate of heat transfer and secondly that said medium can operate at a temperature which lies between the temperature of the hot spent shale train and of the colder fresh shale train in the stage under consideration. The requirement to have high heat transfer coefficients dictates that preferably a condensing-evaporating system has to be chosen. For the first stages at the prevailing operating temperatures methanol is a suitable heat exchange medium, vaporizing at the hot spent shale train side and condensing at the fresh shale train side at the pressures shown. For the further heat transfer loops at the higher operating temperatures condensing-evaporating water at increasing pressures can suitably be applied. For the final stage(s) of the preheating step pressurized water or DOWTHERM ® may be applied. Within the above criteria other suitable heat transfer fluids may be selected.

We claim:

1. A method of preheating particles of a hydrocarbon-bearing substrate by means of hot spent substrate, said particles having a diameter of 0.5 to 5 mm; comprising the steps of:

providing a horizontal fluidized flow of hydrocarbon-bearing substrate and a horizontal fluidized flow of hot spent substrate, while maintaining the hot spent substrate in indirect, countercurrent flow with respect to the flow of the hydrocarbon-bearing substrate;

providing a series of heat transfer loops defining two or more heat transfer stages located between the flows of the hydrocarbon-bearing substrate and the hot spent substrate, each heat transfer loop containing a circulating heat transfer fluid, and each loop being in heat transfer contact with each of said fluidized flows;

choosing said heat transfer fluids such that part of the loops operate in the temperature range of from 65° to 100° C. and part in the temperature range of from 100° to 300° C.

maintaining the horizontal flow of the hot spent substrate in substantially fluidized bed condition in two or more stages, said hot spent substrate being cooled in a staged manner;

maintaining the horizontal flow of the hydrocarbon-bearing substrate in a substantially fluidized bed condition in two or more stages; and indirectly heating the hydrocarbon-bearing substrate in a staged manner from ambient temperature to about 250° C. by means of heat transferred from the hot spent substrate by the heat transfer loops.

2. The method as defined in claim 1, wherein a fluidized medium serves to achieve the fluidized bed condition, said fluidized medium being steam, and wherein at least part of the steam used is recycled to the fluidized beds.

3. The method as defined in claim 1, wherein the heat transfer fluids are circulated between the two flows by means of a thermosyphon effect.

4. The method as defined in claim 3, wherein the heat transfer fluid is methanol.

5. The method as defined in claim 3, wherein the heat transfer fluid is pressurized water.

6. The method as defined in claim 1, wherein the initial temperature of the hot spent substrate is maintained at about 700° C.

7. The method as defined in claim 1, wherein the hydrocarbon-bearing substrate is oil shale.

8. A method of preheating particles of a hydrocarbon-bearing oil shale in two or more stages by means of hot spent oil shale, said particles having a diameter of 0.5 to 5 mm, comprising the steps of:

providing a horizontal fluidized flow of hydrocarbon-bearing oil shale and a horizontal fluidized flow of hot spent shale, while maintaining the horizontal flow of the hot spent shale in substantially fluidized bed condition in two or more stages and in indirect, counter-current flow with respect to the flow of the hydrocarbon-bearing oil shale, said hot spent shale having an initial temperature of 700° C. and being cooled down in a staged manner to a temperature of about 80° C.;

providing a series of heat transfer loops defining two or more heat transfer stages located between the flows of the hydrocarbon-bearing oil shale and the hot spent oil shale, each heat transfer loop containing a circulating heat transfer fluid, and each loop being in heat transfer contact with each of said fluidized flows, said heat transfer fluid vaporizing and condensing while circulating between said flows;

maintaining the horizontal flow of the hydrocarbon-bearing oil shale in substantially fluidized bed condition in two or more stages; and indirectly heating the hydrocarbon-bearing oil shale in a staged manner from ambient temperature to about 250° C. by means of heat transferred from the hot spent oil shale by the heat transfer loops.

9. The method as defined in claim 8, wherein part of the loops operate in the temperature range of from 65° to 100° C. and part in the temperature range of from 100° C. to 300° C.

10. The method as defined in claim 8, wherein the heat transfer fluid is methanol.

11. The method as defined in claim 8, wherein the heat transfer fluid is pressurized water.

12. The method as defined in claim 8, wherein the hot spent oil shale is obtained by further heating the preheated hydrocarbon-bearing oil shale to a temperature of at least 400° C. in the substantial absence of oxygen to yield a coke-bearing spent oil shale and liberated hydrocarbons, and wherein the method further comprises:

combusting the coke-bearing spent oil with a free oxygen-containing gas in a separate combustion step to a hot spent oil shale.

13. The method as defined in claim 12, wherein the coke-bearing spent oil shale is combusted under fluidized bed condition.

14. The method as defined in claim 8, wherein steam is used as the fluidizing medium, and wherein at least part of the steam used is recycled to the fluidized beds.

* * * * *